US006132946A

United States Patent [19]

Takizawa et al.

[11] Patent Number: 6,132,946

[45] **Date of Patent: *Oct. 17, 2000**

[54] SILVER HALIDE COLOR PHOTOGRAPHIC LIGHT-SENSITIVE MATERIAL

[75] Inventors: Hiroo Takizawa; Yasuhiro Yoshioka; Masakazu Morigaki, all of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/019,711

[22] Filed: Feb. 6, 1998

Related U.S. Application Data

[63] Continuation of application No. 08/740,915, Nov. 5, 1996, abandoned, which is a continuation of application No. 08/474,751, Jun. 7, 1995, abandoned.

[30] Foreign Application Priority Data

Aug. 2, 1994 [JP] Japan ..... 6-200140

[51] Int. Cl.[7] ..... G03C 1/38

[52] U.S. Cl. ..... 430/546; 430/377

[58] Field of Search ..... 430/546, 551, 430/638, 377

[56] References Cited

U.S. PATENT DOCUMENTS

| | | | |
|---|---|---|---|
| 4,609,618 | 9/1986 | Sasaki et al. | 430/546 |
| 5,006,437 | 4/1991 | Yoshizawa et al. | 430/551 |
| 5,225,320 | 7/1993 | Kuse et al. | 430/546 |
| 5,462,842 | 10/1995 | Romano, Jr. et al. | 430/555 |

FOREIGN PATENT DOCUMENTS

| | | |
|---|---|---|
| 57-173835 | 10/1982 | Japan . |
| 59-149348 | 8/1984 | Japan . |
| 62-141555 | 6/1987 | Japan . |

OTHER PUBLICATIONS

"Modern Photographic Processing," Grant Haist, vol. 2., 1979, pp. 545–547.

"Science and Technology of Photography," Edited by Karlheinz Keller, 1993, pp. 106–107.

*Primary Examiner*—Hoa Van Le

*Attorney, Agent, or Firm*—Sughrue, Mion, Zinn, Macpeak & Seas, PLLC

[57] ABSTRACT

A silver halide color photographic light-sensitive material comprising a support having thereon one or more layers including at least one light-sensitive silver halide emulsion layer comprising at least one coupler which undergoes a coupling reaction with an oxidized product of an aromatic primary amine developer to form a dye, wherein at least one of the layer(s) on said support comprises at least one compound represented by the following formula (I):

(I)

wherein $R^1$ represents a linear or branched unsubstituted alkenyl group having 3–14 carbon atoms, $R^2$ represents an alkyl group, a cycloalkyl group, a linear or branched unsubstituted alkenyl group having 3–14 carbon atoms, $R^3$ represents a group capable of being substituted on the benzene ring, and m represents an integer from 1 to 4. This may be use as a light-sensitive material which can provide a stable color-image.

23 Claims, No Drawings

SILVER HALIDE COLOR PHOTOGRAPHIC LIGHT-SENSITIVE MATERIAL

This is a continuation of application Ser. No. 08/740,915 filed Nov. 5, 1996, now abandoned, which is a File Wrapper Continuation of Ser. No. 08/474,751 filed on Jun. 7, 1995, now abandoned.

BACKGROUND OF THE INVENTION

1. Field of the Invention

The present invention relates to a silver halide color photographic light-sensitive material, and more particularly to a silver halide color photographic light-sensitive material which has excellent color-image fastness.

2. Description of the Related Art

Photographically usable reagents which are slightly soluble in water include oil-soluble couplers, anti-oxidants for preventing color-fading, color-fogging, and color amalgamation (such as alkyl hydroquinones, alkyl phenols, chromans, and coumarones), membrane-harding agents, oil-soluble filter dyes, oil-soluble UV absorbers, oil-soluble fluorescent whitening agents, DIR compounds (such as DIR hydroquinones and colorless DIR couplers), developers, dye developers, DDR redox compounds, and DDR couplers. They are dissolved in a suitable oil-forming agent, i.e., a solvent with a high boiling point (b.p.). The dissolved reagents are dispersed in a hydrophilic organic colloidal solution, particularly in a gelatin solution, in the presence of a surfactant. In the dispersed state, they are contained in a hydrophilic organic colloidal layer (such as a light-sensitive emulsion layer, a filter layer, a backing layer, an antihalation layer, an intermediate layer, and a protective layer). As the solvent with a high boiling point, phthalic ester compounds and phosphoric ester compounds are generally used.

Esters of phthalic acid and esters of phosphoric acid are organic solvents having a high-boiling point, and have been widely used due to their excellent ability of dispersing couplers, good affinity with colloidal systems such as of gelatin, contribution to the stability of developed colors, contribution to the hue of developed colors, chemical stability when they are included in light-sensitive materials, and availability at low costs.

However, these known high b.p. organic solvents (for example, phthalic esters containing alkyl groups and phosphoric esters containing alkyl groups) are not yet satisfactory for use in recent light-sensitive materials, for which high performance is required, because they are insufficient to prevent fading of color images due to light, heat and humidity, and the generation of stains. For example, high b.p. organic solvents comprising an alkenyl group disclosed in JP-A-59-149,348 and JP-A-57-173,835 have effects insufficient to prevent fading of color images due to light, heat and humidity, and the generation of stains.

It has been desired to overcome these drawbacks, in particular for a silver halide color photographic light-sensitive material comprising a support having thereon one or more layers including at least one light-sensitive silver halide emulsion layer comprising at least one diffusion-resistant coupler which undergoes a coupling reaction with an oxidized product of an aromatic primary amine developer to form a dye.

SUMMARY OF THE INVENTION

An object of the present invention is to provide a silver-halide color light-sensitive material which provides color images which are stable against heat, humidity, and light, and which generates less stains.

Another object of the present invention is to provide a silver-halide color light-sensitive material which has excellent color developing ability.

A further object of the present invention is to provide a silver-halide color light-sensitive material comprising a high boiling point organic solvent which has a great ability of dissolving organic materials such as dye-forming couplers and having excellent effects in preventing color fading of dyes formed as a result of coupling reaction with an oxidized product of an aromatic primary amine developer.

It has now been found that these and other objects can be achieved by a silver halide color photographic light-sensitive material comprising a support having thereon one or more layers including at least one light-sensitive silver halide emulsion layer comprising at least one coupler which undergoes a coupling reaction with an oxidized product of an aromatic primary amine developer to form a dye, wherein at least one of the layer(s) on said support comprises at least one compound represented by the following formula (I):

(I)

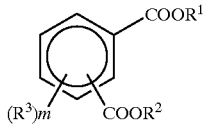

wherein $R^1$ represents C3–C14 linear or branched unsubstituted alkenyl, $R^2$ represents alkyl, cycloalkyl, C3–C14 linear or branched unsubstituted alkenyl, $R^3$ represents a group capable of being substituted on the benzene ring, and m represents an integer from 0 to 4. (In the specification, Cp–Cq means having from p to q carbon atoms(p,q: numbers).)

It has also been found that, when both $R^1$ and $R^2$ in formula (I) are C3–C14 unsubstituted alkenyl represented by formula (II), the above objects are more effectively achieved.

(II)

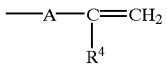

wherein $R^4$ represents hydrogen or unsubstituted alkyl, and A represents alkylene or alkenylene composed merely of carbon and hydrogen atoms (hereinafter, the alkenyl group represented by formula (II) is referred to as "terminal alkenyl group").

It has also been found that, when both group $R^1$ and $R^2$ in formula (I) are terminal alkenyl groups, which are represented by formula (II), the above objects are more effectively achieved.

DESCRIPTION OF THE PREFERRED EMBODIMENTS

The present invention will next be described in detail.

When the substituents in formula (I) contain aliphatic moieties, these aliphatic moieties may be linear, straight, or cyclic, and saturated or unsaturated, and substituted or unsubstituted if there is not any other indication. However, the alkenyl groups in $R^1$ and $R^2$ are not substituted.

When the substituents in formula (I) contain aryl moieties, these aryl moieties may be substituted or unsubstituted, and may form a single ring or a condensed ring.

When the substituents in formula (I) contain heterocyclic moieties, the hetero atoms which form the rings of the heterocyclic moieties may be nitrogen, oxygen, or sulfur, and each ring may preferably have 5–8 members. Carbon atoms and nitrogen atoms on the ring may be substituted or unsubstituted, and the ring may be a single ring or a condensed ring.

In formula (I), the C3–C14 linear or branched, unsubstituted alkenyl as $R^1$ or $R^2$ is preferably a "terminal alkenyl" group, which is represented by formula (II).

(II)

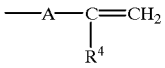

In formula (II), $R^4$ represents hydrogen or alkyl (preferably C1–C12 alkyl), more preferably hydrogen or methyl, and more preferably hydrogen. The symbol A represents alkylene (preferably C1–C12 alkylene) or alkylene (preferably C2–C12 alkenylene) which is merely composed of hydrogen and carbon atoms.

Among the alkenyl groups represented by $R^1$ and $R^2$, the "terminal alkenyl" groups of the following formula (III) are preferred.

(III)

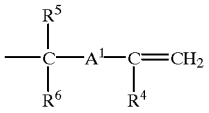

wherein $R^5$ and $R^6$ respectively represent hydrogen, C1–C4 unsubstituted alkyl, or C2–C4 unsubstituted alkenyl, $A^1$ represents a single bond C1–C10 unsubstituted alkylene or C2–C10 alkenylene, $R^4$ has the same meaning as defined in formula (II). $R^5$ and $R^6$ are preferably hydrogen, methyl, ethyl, or vinyl, with hydrogen being particularly preferred.

Specific examples of the alkenyl groups represented by $R^1$ and $R^2$ are listed below, which should not be construed as limiting the invention thereto.

a) $-CH_2-CH=CH_2$ b) $-CH_2-CH=CHCH_3$ c) $-CH_2CH_2CH=CH_2$ d) $-CH_2CH_2C(CH_3)=CH_2$ e) $-(CH_2)_3CH=CH_2$ f) $-CH_2-CH=CHC_2H_5$ g) $-CH_2-CH=C(CH_3)_2$ h) $-(CH_2)_4CH=CH_2$

-continued i) $-CH_2-CH=CH-C_3H_7(n)$ j) $-CH_2CH=CH-CH=CH-CH_3$ k) $-(CH_2)_2CH=CH-C_4H_9$ l) $-CH_2-CH=CH-(CH_2)_3CH=CH_2$ m) $-CH_2-CH=CH-CH=CH-C_5H_{11}(n)$ n) $-CH_2-CH=CH-CH=CH-C_7H_{15}(n)$

O) $-CH_2CH=C(CH_3)CH_2CH_2CH=C(CH_3)_2$ p) $-C(CH_3)(CH=CH_2)-CH_2CH_2CH=C(CH_3)_2$ q) $-(CH_2)_8CH=CH_2$ r) $-(CH_2)_9CH=CH_2$ s) $-(CH_2)_{12}CH=CH_2$ t) $-C(CH_3)_2CH=CH_2$ u) $-CH(C_2H_5)CH=CH_2$

If the alkenyl groups have geometrical isomers, they may be composed merely of either one of cis- or trans-, or may be a mixture of them. Among the above-listed species, the "terminal alkenyl" groups represented by the following a), c), d), e), n), l), p), q), r), s), and u) are preferred.

In formula (I), $R^2$ may be C1–C30 alkyl (such as methyl, ethyl, isopropyl, t-butyl, chloromethyl, benzyl, octyl, 2-ethylhexyl, 3,5,5-trimethylhexyl, decyl, dodecyl, isotridecyl, and 2-hexyldecyl), C3–C30 cycloalkyl (cyclopropyl, cyclopentyl, and cyclohexyl), C6–C30 aryl (for example, phenyl and 2-naphthyl), as well as C3–C14 linear or branched, unsubstituted alkenyl (the same as $R^1$). $R^2$ is preferably unsubstituted alkenyl.

In formula (I), $R^1$ and $R^2$ are preferably unsubstituted alkenyl as described above. $R^1$ and $R^2$ are more preferably C3–C10 unsubstituted alkenyl, and most preferably C3–C8 unsubstituted terminal alkenyl. Specifically, the alkenyl groups represented by a), b), c), d), e), h), l), p), q), and u) are preferred, with a), d), l), h), and q) being particularly preferred.

In formula (I), it is preferable that groups $R^1$ and $R^2$ are the same. Moreover, the group —$COOR^2$ is preferably at the ortho- or para- position relative to the group —$COOR^1$, and more preferably at the ortho- position.

In formula (I), $R^3$ represents a group which is capable of being substituted on the benzene ring. Preferably, $R^3$ is a C1–C30 aliphatic group (such as methyl, t-butyl, allyl, cyclohexyl, and benzyl), C6–C30 aryl (such as phenyl or 2-naphthyl), C2–C30 aliphatic oxycarbonyl (such as methoxycarbonyl and allyloxycarbonyl), C1–C30 carbamoyl (such as N-methylcarbamoyl and N,N-dioctylcarbamoyl), halogen (such as chlorine, bromine, and fluorine), cyano, C1–C30 acylamino (such as acetamino and benzoylamino), and C1–C30 alkoxy (such as methoxy and 2-ethylhexyloxy) and the like. Among them, an aliphatic group, aliphatic oxycarbonyl, carbamoyl, alkoxy and halogen are preferred. Alkenoxycarbonyl is more preferred, and allyloxycarbonyl is particularly preferred. (The two types of oxycarbonyl are included in aliphatic oxycarbonyl.)

The character m represents an integer from 0 to 4, preferably 0 or 1, more preferably 0.

When m is 1 or 2, a combination is preferred in which $R^3$ is allyloxycarbonyl and $R^1$ and $R^2$ are both allyl.

When m is 4, $R^3$ is preferably halogen.

In this connection, when m is not less than 2, a plurality of $R^3$ may be the same or different from each other, and may be linked to each other to form a ring.

Among the compounds of formula (I) according to the present invention, particularly preferable ones are represented by formula (IV).

(IV)

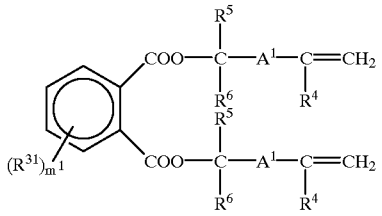

wherein $A^1$, $R^5$, and $R^6$ have the same meaning as defined in formula (III), and $R^4$ has the same meaning as defined in formula (II). $R^{31}$ is alkenoxycarbonyl and $m^1$ is 0 or 1.

Specific examples of the compounds of formula (I) according to the present invention are shown below, which should not be construed as limiting the invention thereto.

S-1

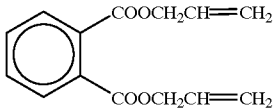

S-2

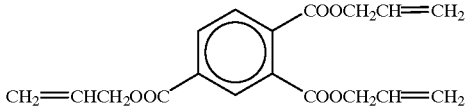

S-3

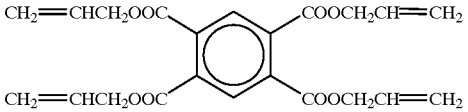

S-4

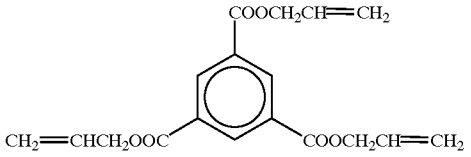

S-5

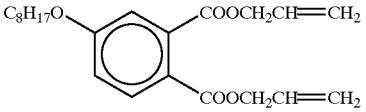

S-6

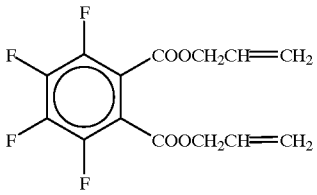

S-7

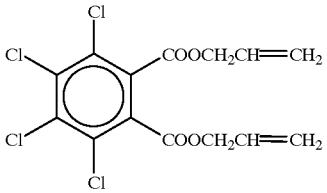

S-8

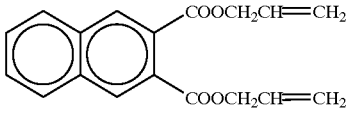

S-9

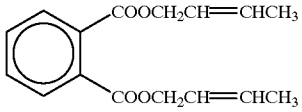

S-10

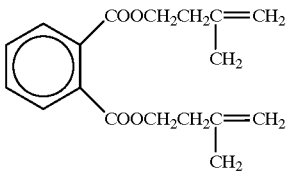

S-11

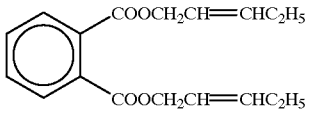

S-12

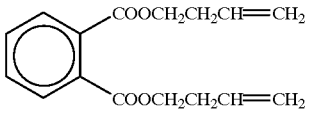

-continued
S-13
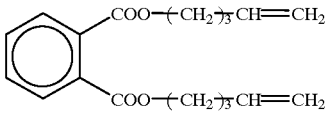
S-14
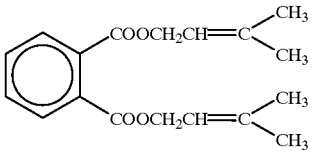
S-15
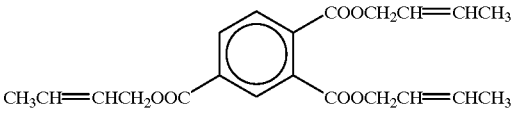
S-16
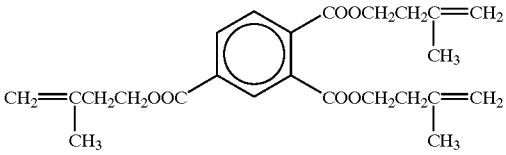
S-17
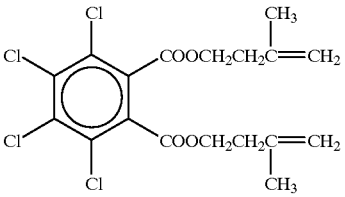
S-18
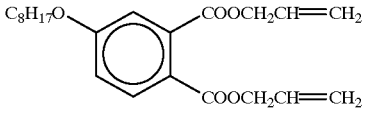
S-19
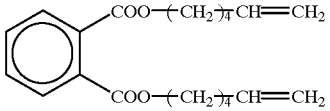
S-20
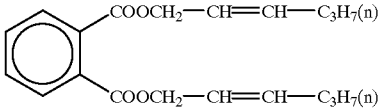
S-21
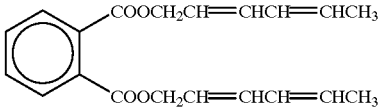
S-22
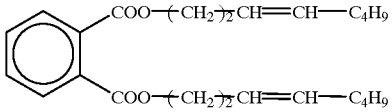
S-23
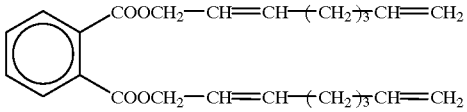
S-24
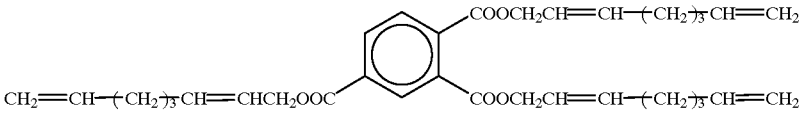
S-25
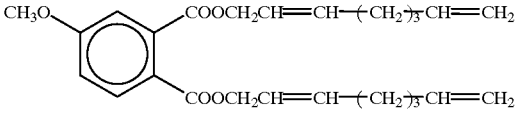
S-26
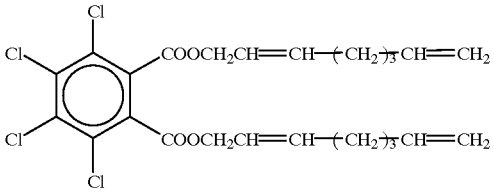
S-27
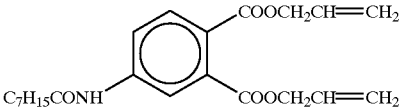
S-28
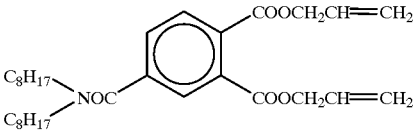
S-29
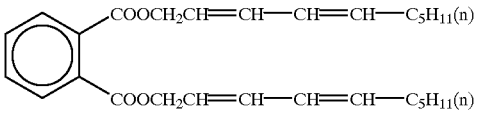
S-30
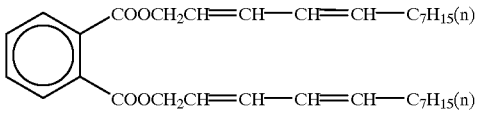

-continued

S-31

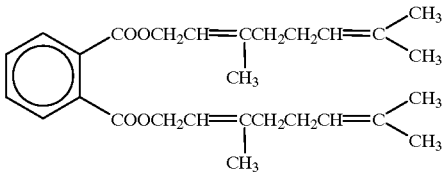

S-32

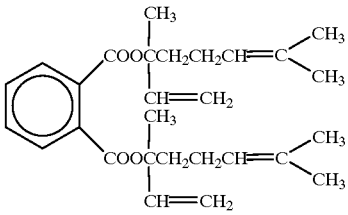

S-33

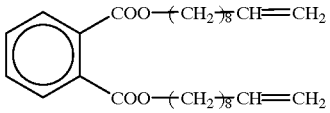

S-34

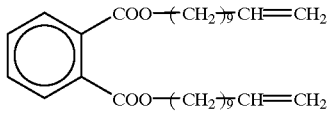

S-35

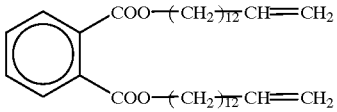

S-36

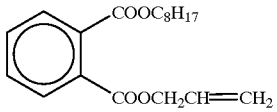

S-37

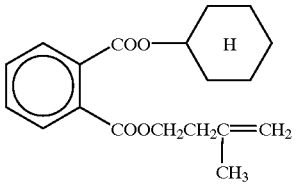

S-38

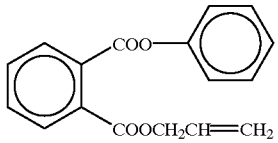

S-39

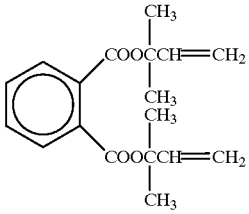

S-40

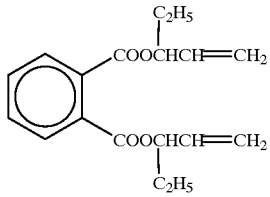

S-41

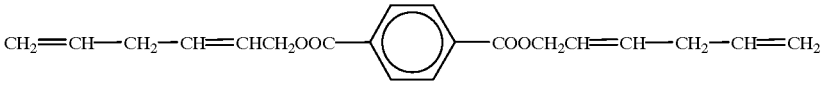

S-42

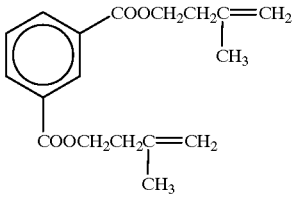

S-43

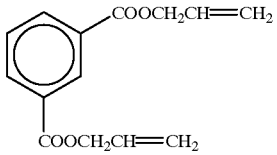

S-44

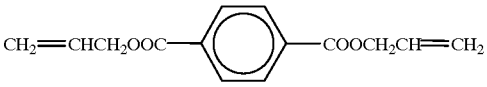

Some of the compounds (I) which are used in the present invention are commercially available. For example, S-1 is obtainable from Tokyo Chemical Industry Co. and Daiso Co., Ltd, and S-2 is obtainable from Wako Pure Chemical Industries Co.

If not commercially available, other species of formula (I) can be synthesized, with high yield, by a known reaction such as an esterification reaction of a carboxylic chloride or carboxylic anhydride and an alcohol or an esterification reaction, in the presence of an acid catalyst, between a carboxylic acid and an alcohol (see, for example, New Experimental Chemistry Course 14 II, pp. 1002–1062, published by Maruzen, Japan).

The compound (1) in the present invention is contained in at least one layer on a support, which is preferably a hydrophilic colloidal layer. More preferably, the compound (I) in the invention is contained in a silver halide emulsion layer containing at least one of a dye-forming diffusion-resistant coupler mentioned above.

The compounds of formula (I) according to the present invention primarily function as high b.p. organic solvents. The term "high b.p." refers to a boiling point of not less than 175° C. under atmospheric pressure. The amount of the compound of formula (I) in use may vary depending on an intended purpose, and is not particularly limited. It is preferably from 0.0002 g to 20 g, more preferably from 0.001 g to 5 g, per $m^2$ of a light-sensitive material. Generally, the weight ratio of the amount of compound (I) to the total amount of the photographically usable reagents such as couplers is within the range from 0.01 to 8, more preferably from 0.01 to 4, and most preferably from 0.05 to 2.

The weight ratio of the amount of a dispersion composed of the compound of formula (I) and photographically usable reagents such as a coupler to the amount of a dispersion medium is usually from 2 to 0.01, and preferably from 1.0 to 0.0 5. Typical example of the dispersion medium includes gelatin. Hydrophilic polymers such as polyvinyl alcohol can also be used. The dispersion in the present invention may further contain a variety of optional components other than the compounds (I) of the present invention and photographically usable reagents.

The compound of formula (I) may be used in combination with any other conventionally known high b.p. organic solvent. When the known high b.p. organic solvent is co-used, the amount of the compound (I) of the present invention is preferably from 5 to 100% by weight, more preferably from 10 to 70% by weight, and most preferably from 20 to 60% by weight of the total amount of the high b.p. organic solvents.

Examples of the high b.p. solvents which may be used in combination with the compound (I) of the present invention are described, for example, in U.S. Pat. No. 2,322,027. Specific examples of the high b.p. organic solvents with a boiling point of 175° C. or higher under atmospheric pressure include phthalic esters (such as dibutylphthalate, dicyclohexylphthalate, di-2-ethylhexylphthalate, decylphthalate, bis(2,4-di-tertamylphenyl)phthalate, bis(2,4-di-tert-amylphenyl)isophthalate, bis(1,1-diethylpropyl) phthalate, phosphoric or phosphonic esters (such as triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoic esters (such as 2-ethylhexylbenzoate, dodecylbenzoate, and 2-ethylhexyl-p-hydroxybenzoate), amides (such as N,N-diethyl dodecaneamide, N,N-diethyl laurylamide, and N-tetradecylpyrrolidone), sulfonamides (such as N-butylbenzene sulfonamides), alcohols or phenols (such as isostearyl alcohol and 2,4-di-tert-amylphenol), aliphatic carboxylic esters (such as bis(2-ethylhexyl) sebacate, dioctyl azelate, glycerol tributyrate, isostearyl lactate, and trioctyl citrate), aniline derivatives (such as N,N-dibutyl-2-butoxy-5-tert-octylaniline, etc.), hydrocarbons (such as paraffin, dodecylbenzene, and diisopropyl naphthalene), and chlorinated paraffins. Useful auxiliary solvents include organic solvents with a boiling point of 30° C. or more, preferably a boiling point within the range from 50° C. to approximately 160° C. Typical examples of the auxiliary solvents include ethyl acetate, butyl acetate, ethyl propionate, methylethylketone, cyclohexanone, 2-ethoxyethylacetate, and dimethylformamide.

Examples of the light-sensitive material and dye-forming coupler which are used in the present invention are listed, for example, in JP-A-62-215,272, JP-A-2-23,144, and EP 355, 660 A2, which are incorporated herein by reference.

A diffusion-resistant coupler can be used as a coupler essential to the present invention. The diffusion-resistant coupler is a dye-forming coupler which preferably has a substituted or unsubstituted aliphatic or aryl group which has 8 or more, preferably 10 or more, more preferably 12 or more, most preferably 14 or more carbon atoms, in any moiety thereof, so as to prevent ambiguity or blur of a color image due to transfer, in a film, of the dye-forming coupler in the film or a formed dye.

EXAMPLES

Example 1

A single-layer light-sensitive material 101 for evaluation which had the following layer structure was prepared using a triacetylcellulose support with an undercoat thereon.

Preparation of a Coating Solution for Emulsion Layer

R-1, as shown below, was added to 1.85 mmol of a coupler in an amount of 60% by weight of the coupler, after which 10 ml of ethyl acetate was added thereto. The resulting mixture was heated for dissolution. The obtained solution was then emulsified and dispersed in 33 g of 14% aqueous gelatin solution containing 3 ml of 10% sodium dodecylbenzene sulfonate solution to obtain an emulsion. Separately, a silver chlorobromide emulsion was prepared (cubic, mixture of large-grain emulsion having an average grain size of 0.88 $\mu$m and small-grain emulsion having an average grain size of 0.70 $\mu$m (3:7 in molar ratio of silver). The variation coefficients of distribution of the grain sizes were 0.08 for the large-grain emulsion and 0.10 for the small-grain emulsion. In the grains of both sizes, 0.3 mol % of silver bromide was locally included into a part of the surface portion of each,grain. A sulfur sensitizer and a gold sensitizer were added for chemical ripening of the emulsion. The above-described emulsion and the silver chlorobromide emulsion were mixed and dissolved to prepare a coating solution having the following formulation. A sodium salt of 1-oxy-3,5-dichloro-s-triazine acid was used as a setting agent.

Structure of the Layers

The composition of the layer used in this Example is shown below, wherein the figures indicate the amount of coating per $m^2$).

| | |
|---|---|
| Support: | |
| Triacetylcellulose support | |
| Emulsion layer: | |
| The above-described silver chlorobromide | 3.0 mmol |
| Coupler | 1.0 mmol |
| R-1 | 60 wt % (based on the coupler) |
| Gelatin | 5.5 g |
| Protective layer: | |
| Gelatin | 1.5 g |
| Acrylic modified copolymer of polyvinyl alcohol (degree of modification: 17%) | 0.15 g |
| Liquid paraffin | 0.03 g |

Specific high b.p. solvents and yellow couplers used in the Example are shown below.

R-1
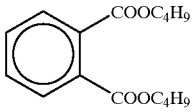
R-2
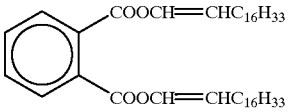
R-3
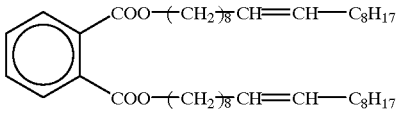
Y-1
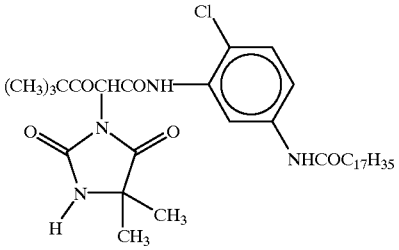
Y-2
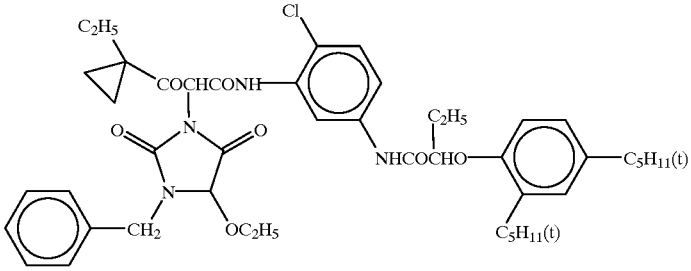
Y-3
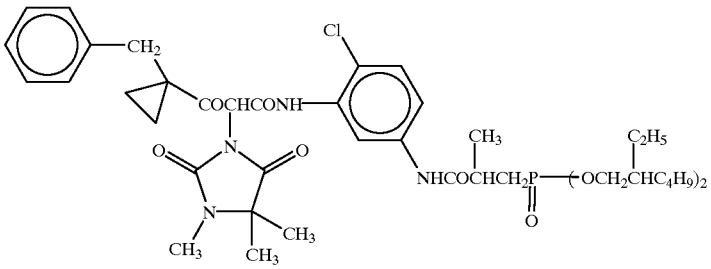
Y-4
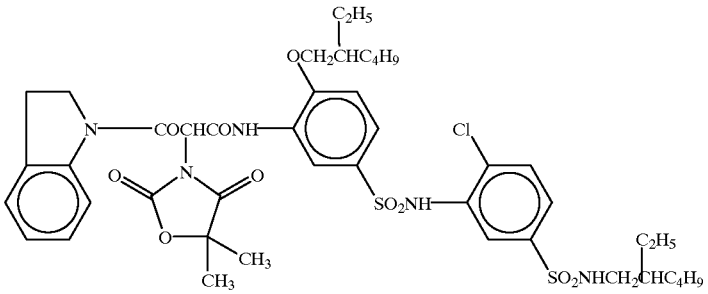
Y-5
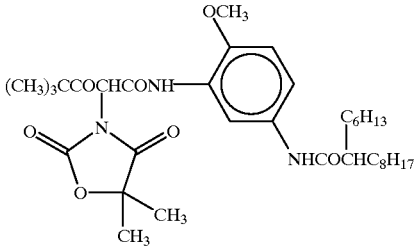

-continued

Y-6

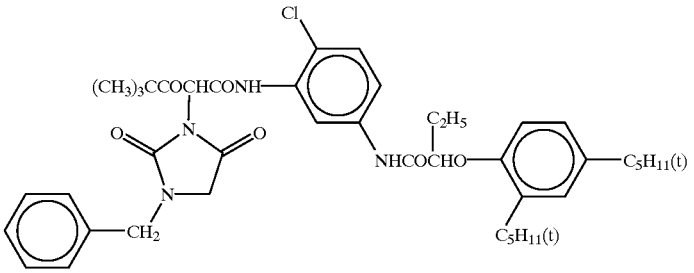

Samples 102–134 were prepared in the same manner as that used for sample 101, excepting that the coupler and the high b.p. organic solvent were replaced with those shown in Table 1 (Table A). The coupler was used so as to conduct equivalent-mole replacement. As to the solvent R-1, a half of it by weight was replaced with the high b.p. solvents shown in Table A.

The samples 101–134 were subjected to imagewise exposure using an optical wedge and were processed by the following processing steps.

| Processing step | Temperature | Time |
|---|---|---|
| Color development | 35° C. | 45 sec. |
| Bleaching/fixing | 35° C. | 45 sec. |
| Stabilizing (1) | 35° C. | 20 sec. |
| Stabilizing (2) | 35° C. | 20 sec. |
| Stabilizing (3) | 35° C. | 20 sec. |
| Stabilizing (4) | 35° C. | 20 sec. |
| Drying | 80° C. | 60 sec. |

(Stabilizing was effected by a 4-tank counter flow method from (4) to (1))

The compositions of the processing solutions were as follows:

| | Tank solution |
|---|---|
| Color developing solution | |
| Water | 800 ml |
| 1-Hydroxyethylidene-1,1-diphosphonic acid (60%) | 0.8 ml |
| Triethanolamine | 8.0 g |
| Sodium chloride | 1.4 g |
| Potassium bromide | 0.03 g |
| N,N-diethylhydroxylamine | 4.6 g |
| Potassium carbonate | 27 g |
| Sodium sulfite | 0.1 g |
| N-ethyl-N-(β-methanesulfonamide ethyl)-3-methyl-4-aminoaniline 3/2 sulfuric acid · $1H_2O$ | 4.5 g |
| Lithium sulfate (anhydrous) | 2.7 g |
| Fluorescent whitening agent (containing 4,4'-diaminostilbene) | 2.0 g |
| Total amount after adding water | 1000 ml |
| pH (adjusted with potassium hydroxide and sulfuric acid) | 10.25 |
| Bleaching/fixing solution | |
| Water | 400 ml |
| Ammonium thiosulfate (700 g/liter) | 100 ml |
| Sodium sulfite | 18 g |

-continued

| | Tank solution |
|---|---|
| Iron (III) (ethylenediamine-tetraacetate) ammonium | 55 g |
| Disodium ethylenediamine-tetraacetate | 3 g |
| Glacial acetic acid | 9 g |
| Total amount after adding water | 1000 ml |
| pH (adjusted with acetic acid and ammonia) | 5.4 |
| Stabilizing solution | |
| 1,2-Bezoisothiazoline-3-one | 0.02 g |
| Polyvinylpyrrolidone | 0.05 g |
| Total amount after adding water | 1000 ml |
| pH | 7.0 |

The color development density of the processed samples was measured using blue light. Maximum color development densities of the samples are shown in Table A.

Subsequently, the samples were stored for 10 days while being exposed to Xe light of 80,000 lux (intermittent irradiation of alternating 5-hour irradiation and 1-hour non-irradiation). Thereafter, the density of the samples was measured again using blue light, thereby obtaining their color-image residual rates.

Separately, the samples were stored for 14 days at 80° C. and 70% RH. The density of these samples was measured in a similar manner to obtain their color image residual rates.

Each color image residual rate was obtained at the point exposed in an amount of exposure which provided half the maximum color development density, as initial density. The results are shown in Table A.

TABLE A

| Sample | Coupler | high b.p. solvent | Dmax | Color image residual rate (Xe) | Color image residual rate (80–70%) | |
|---|---|---|---|---|---|---|
| 101 | Y-1 | R-1 (Solv-2) | 1.69 | 71 | 74 | C |
| 102 | Y-1 | S-1 | 1.78 | 86 | 85 | I |
| 103 | Y-1 | S-2 | 1.77 | 85 | 80 | I |
| 104 | Y-1 | S-9 | 1.78 | 82 | 78 | I |
| 105 | Y-1 | S-10 | 1.77 | 87 | 85 | I |
| 106 | Y-1 | S-12 | 1.78 | 85 | 79 | I |
| 107 | Y-1 | S-13 | 1.76 | 85 | 82 | I |
| 108 | Y-1 | S-14 | 1.74 | 81 | 77 | I |
| 109 | Y-1 | S-16 | 1.76 | 86 | 83 | I |
| 110 | Y-1 | S-19 | 1.75 | 86 | 83 | I |
| 111 | Y-1 | S-23 | 1.76 | 86 | 86 | I |
| 112 | Y-1 | S-29 | 1.74 | 80 | 80 | I |

TABLE A-continued

| Sample | Coupler | high b.p. solvent | Dmax | Color image residual rate (Xe) | (80–70%) | |
|---|---|---|---|---|---|---|
| 113 | Y-1 | S-31 | 1.73 | 78 | 80 | I |
| 114 | Y-1 | S-33 | 1.76 | 86 | 86 | I |
| 115 | Y-1 | S-36 | 1.76 | 82 | 81 | I |
| 116 | Y-2 | R-1 | 1.96 | 55 | 85 | C |
| 117 | Y-2 | S-1 | 2.01 | 76 | 91 | I |
| 118 | Y-2 | S-10 | 2.00 | 79 | 90 | I |
| 119 | Y-3 | R-1 | 2.05 | 47 | 91 | C |
| 120 | Y-3 | S-1 | 2.12 | 77 | 95 | I |
| 121 | Y-3 | S-10 | 2.10 | 79 | 96 | I |
| 122 | Y-4 | R-1 | 2.08 | 63 | 95 | C |
| 123 | Y-4 | S-1 | 2.15 | 82 | 98 | I |
| 124 | Y-4 | S-10 | 2.17 | 85 | 99 | I |
| 125 | Y-5 | R-1 | 1.81 | 67 | 72 | C |
| 126 | Y-5 | S-1 | 1.85 | 80 | 77 | I |
| 127 | Y-5 | S-10 | 1.84 | 82 | 78 | I |
| 128 | Y-6 | R-1 | 1.68 | 78 | 80 | C |
| 139 | Y-6 | S-1 | 1.73 | 89 | 87 | I |
| 130 | Y-6 | S-10 | 1.72 | 91 | 89 | I |
| 131 | Y-1 | R-2 | 1.62 | 73 | 75 | C |
| 132 | Y-1 | S-41 | 1.72 | 84 | 85 | I |
| 133 | Y-1 | S-42 | 1.73 | 83 | 83 | I |
| 134 | Y-1 | R-3 | 1.62 | 73 | 72 | C |

I: Example of the present invention
C: Comparative example (This is the same as in other tables.)

As is apparent from Table A, when the high b.p. solvents defined in the present invention are used, a higher color development density and higher image fastness can be obtained as compared to coupler Y-1. It is also apparent that similar advantageous effects can be obtained as to couplers Y-2, Y-3, Y-4, Y-5 and Y-6.

By contrast, the advantageous effects of the present invention, i.e., increase in color development density and improvement of fastness cannot be obtained if known compounds R-2 and R-3 are used which have structures similar to that of the high b.p. solvents according to the present invention but have an alkenyl group of 18 carbon atoms.

Example 2

A surface of a paper support, both surfaces of which had been laminated with polyethylene, was subjected to a corona discharging treatment, and thereafter a gelatin undercoat layer containing sodium dodecylbenzenesulonate was provided thereon. Furthermore, various photographic constituent layers were formed thereon to prepare a multilayer color printing paper 201 having the structure as described below. The coating solutions were prepared in the following manner.

Preparation of a Coating Solution for a First Layer 122.0 g of a yellow coupler ExY-1, 30.8 g of a first color image stabilizer Cpd-1, 7.5 g of a second color image stabilizer Cpd-2, and 16.7 g of a third color image stabilizer Cpd-3 were dissolved in a mixture of a solvent Solv-1 (44 g) and ethyl acetate (180 ml). The solution was then emulsified and dispersed in 1000 g of 10% aqueous gelatin solution containing 86 ml of 10% sodium dodecylbenzene sulfonate to obtain an emulsified dispersion A. Separately, a silver chlorobromide emulsion A was prepared (cubic, mixture of large-grain emulsion A having an average grain size of 0.88 μm and small-grain emulsion A having an average grain size of 0.70 μm (3:7 in molar ratio of silver)). The variation coefficients of distribution of the grain sizes were 0.08 for the large-grain emulsion and 0.10 for the small-grain emulsion. In the grains of both sizes, 0.3 mol % of silver bromide was locally included into a part of the surface portion of each grain. The below-described blue color sensitizing dyes A,B and C were respectively added to large-grain emulsion A in an amount of $8.0\times10^{-5}$ mol/mol silver, and to small-grain emulsion A in an amount of $1.0\times10^{-4}$ mol/mol silver. A sulfur sensitizer and a gold sensitizer were added for chemical ripening of the emulsion. The above-described emulsified dispersion A and the silver chlorobromide emulsion A were mixed and dissolved to prepare a coating solution for a first layer so as to have the following composition. The amount of the emulsion used for coating was indicated by the amount of silver.

Coating solutions for second to seventh layers were prepared in a similar manner. A sodium salt of 1-oxy-3,5-dichloro-s-triazine was used as a gelatin setting agent in each layer.

Also, Cpd-12, Cpd-13, Cpd-14 and Cpd-15 were added in each layer so that their total amounts become 15.0 mg/m$^2$, 60.0 mg/m$^2$, 5.0 mg/m$^2$ and 10.0 mg/m$^2$, respectively.

For the silver chlorobromide emulsion in each light-sensitive emulsion layer, the following spectral sensitizing dyes were used:

Blue Sensitive Emulsion Layer

Blue sensitive emulsion layer:

Sensitizing Dye A

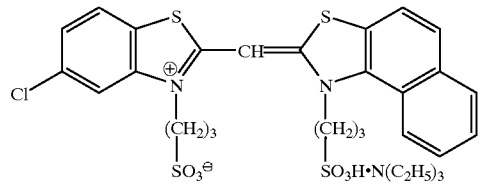

Sensitizing Dye B

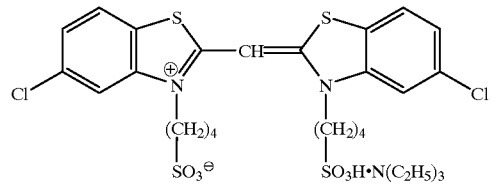

Sensitizing Dye C

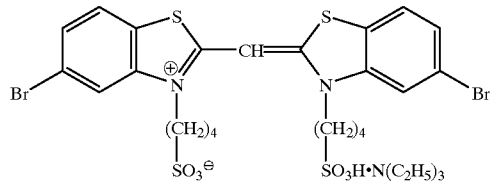

The above compound was added to the large-grain emulsion in an amount of $1.4\times10^{-4}$ mol/mol silver halide, and to the small-grain emulsion in an amount of $1.7\times10^{-4}$ mol/mol silver halide.

Green Sensitive Emulsion Layer

Green sensitive emulsion layer:

Sensitizing Dye D

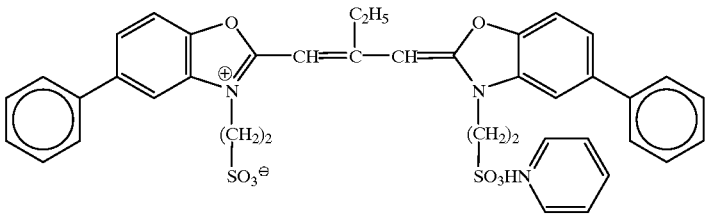

Sensitizing Dye E

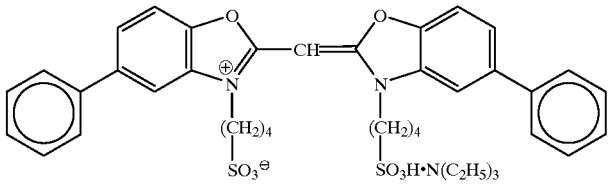

Sensitizing Dye F

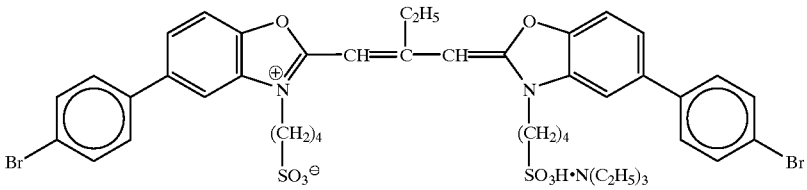

The sensitizing dye D was added to the large-grain emulsion in an amount of $3.0\times10^{-4}$ mol/mol silver halide, and to the small-grain emulsion in an amount of $3.6\times10^{-4}$ mol/mol silver halide. The sensitizing dye E was added to the large-grain emulsion in an amount of $4.0\times10^{-5}$ mol/mol silver halide, and to the small-grain emulsion in an amount of $7.0\times10^{-5}$ mol/mol silver halide. The sensitizing dye F was added to the large-grain emulsion in an amount of $2.0\times10^{-4}$ mol/mol silver halide, and to the small-grain emulsion in an amount of $2.8\times10^{-4}$ mol/mol silver halide.

Red Sensitive Layer

Red sensitive layer:

Sensitizing Dye G

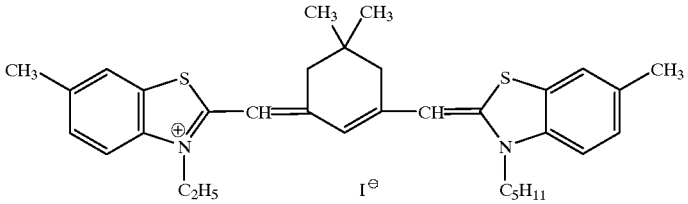

Sensitizing Dye H

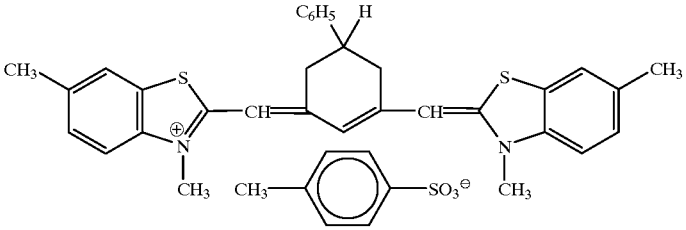

The above compound was added to the large-grain emulsion in an amount of $5.0\times10^{-5}$ mol/mol silver halide, and to the small-grain emulsion in an amount of $8.0\times10^{-5}$ mol/mol silver halide.

In addition, the following compound was added to the red sensitive emulsion layer in an amount of $2.6\times10^{-3}$ mol/mol silver halide.

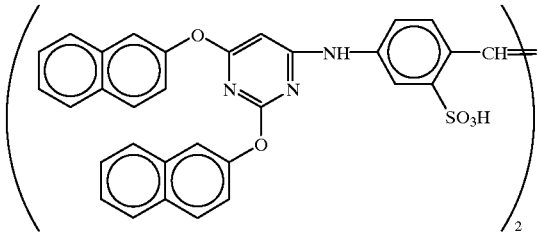

Also, 1-(5-methylureidophenyl)-5-mercaptotetrazole was added to the blue sensitive emulsion layer, green sensitive emulsion layer, and red sensitive emulsion layer, in amounts of $3.3\times10^{-4}$ mol, $1.0\times10^{-3}$ mol, and $5.9\times10^{-4}$ mol, respectively, with respect to 1 mol of silver halide.

Moreover, they were added to the second, fourth, sixth and seventh layers so that their amounts become 0.2 mg/m$^2$, 0.2 mg/m$^2$, 0.6 mg/m$^2$ and 0.1 mg/m$^2$, respectively.

Additionally, 4-hydroxy-6-methyl-1,3,3a,7-tetrazaindene was added to the blue sensitive emulsion layer and green sensitive emulsion layer in amounts of $1\times10^{-4}$ mol and $2\times10^{-4}$ mol, respectively, with respect to 1 mol of silver halide.

The below described dye was further added to the emulsion layers for preventing irradiation (values in the parentheses indicate the amount of dies applied).

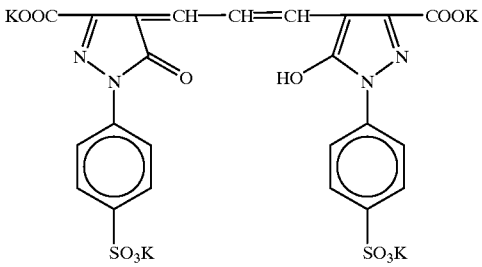

(10 mg/m$^2$)

and

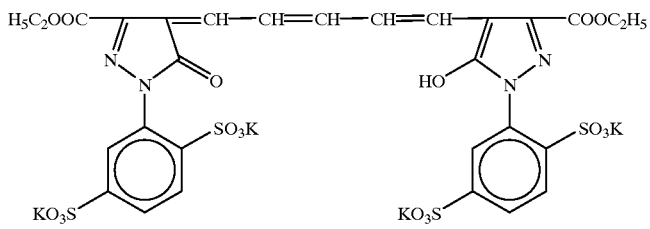

(40 mg/m$^2$)

Structure of the Layers

The composition of each layer is shown below, wherein the figures indicate the amount of coating (g/m$^2$). The amount of silver halide is shown by the amount of silver contained therein.

Support

Polyethylene-laminated paper (The polyethylene film on the side of the first layer contained a white pigment ($TiO_2$, 15% by weight) and a blue dye (ultramarine).

| | |
|---|---|
| First layer (blue sensitive emulsion layer): | |
| The above-described silver chlorobromide emulsion A | 0.27 |
| Gelatin | 1.60 |
| Yellow coupler (ExY-1) | 0.61 |
| Color image stabilizer (Cpd-1) | 0.16 |
| Color image stabilizer (Cpd-2) | 0.04 |
| Color image stabilizer (Cpd-3) | 0.08 |
| Solvent (Solv-1) | 0.22 |
| Second layer (color amalgamation preventing layer): | |
| Gelatin | 0.99 |
| Color amalgamation preventing agent (Cpd-4) | 0.10 |
| Solvent (Solv-1) | 0.07 |
| Solvent (Solv-2) | 0.20 |
| Solvent (Solv-3) | 0.15 |
| Solvent (Solv-7) | 0.12 |
| Third layer (green sensitive emulsion layer): | |
| Silver chlorobromide (cubic, a mixture of large-grain emulsion B having an average grain size of 0.55 μm and small-grain emulsion B having an average grain size of 0.39 μm (1:3 in molar ratio of silver). The variation coefficients of distribution of the grain sizes were 0.10 for the large-grain emulsion and 0.08 for the small-grain emulsion. In the grains of both sizes, 0.8 mol % of silver bromide was locally included into a part of the surface portion of each grain containing | 0.13 |

-continued

| | |
|---|---|
| silver chloride as a matrix.) | |
| Gelatin | 1.35 |
| Magenta coupler (ExM-1) | 0.12 |
| Ultraviolet absorbing agent (UV-1) | 0.12 |
| Color image stabilizer (Cpd-2) | 0.01 |
| Color image stabilizer (Cpd-5) | 0.01 |
| Color image stabilizer (Cpd-6) | 0.01 |
| Color image stabilizer (Cpd-7) | 0.08 |
| Color image stabilizer (Cpd-8) | 0.01 |
| Solvent (Solv-4) | 0.30 |
| Solvent (Solv-5) | 0.15 |
| Fourth layer (color amalgamation preventing layer): | |
| Gelatin | 0.72 |
| Color amalgamation preventing agent (Cpd-4) | 0.07 |
| Solvent (Solv-1) | 0.05 |
| Solvent (Solv-2) | 0.15 |
| Solvent (Solv-3) | 0.12 |
| Solvent (Solv-7) | 0.09 |
| Fifth layer (red sensitive emulsion layer): | |
| Silver chlorobromide (cubic, a mixture of large-grain emulsion C having an average grain size of 0.50 μm and small-grain emulsion C having an average grain size of 0.41 μm (1:4 in molar ratio of silver). The variation coefficients of distribution of the grain sizes were 0.09 for the large-grain emulsion and 0.11 for the small-grain emulsion. In the grains of both sizes, 0.8 mol % of silver bromide was locally included into a part of the surface portion of each grain containing | 0.18 |

-continued

| | |
|---|---|
| silver chloride as a matrix.) | |
| Gelatin | 0.80 |
| Cyan coupler (ExC-1) | 0.28 |
| Ultraviolet absorbing agent (UV-3) | 0.19 |
| Color image stabilizer (Cpd-1) | 0.24 |
| Color image stabilizer (Cpd-6) | 0.01 |
| Color image stabilizer (Cpd-8) | 0.01 |
| Color image stabilizer (Cpd-9) | 0.04 |
| Color image stabilizer (Cpd-10) | 0.01 |
| Solvent (Solv-1) | 0.01 |
| Solvent (Solv-6) | 0.21 |
| Sixth layer (Ultraviolet absorbing layer): | |
| Gelatin | 0.64 |
| Ultraviolet absorbing agent (UV-2) | 0.39 |
| Color image stabilizer (Cpd-7) | 0.05 |
| Solvent (Solv-8) | 0.05 |
| Seventh layer (Protective layer): | |
| Gelatin | 1.01 |
| Acrylic modified copolymer of polyvinyl alcohol (degree of modification: 17%) | 0.04 |
| Liquid paraffin | 0.02 |
| Surfactant (Cpd-11) | 0.01 |

The compounds used for forming the above-described layeres are shown below.

(ExY-1) Yellow Coupler

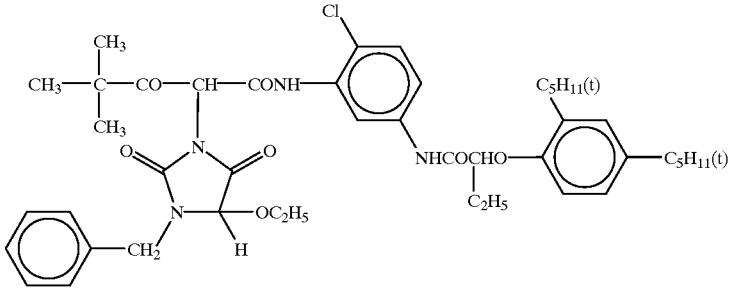

(ExY-2)

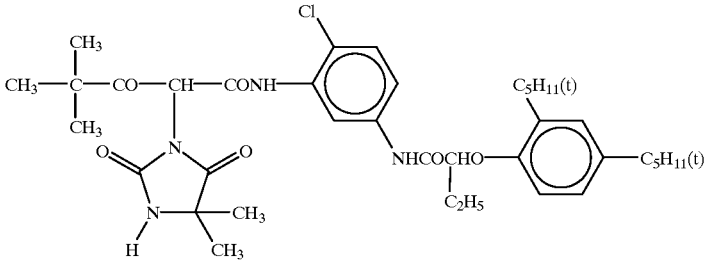

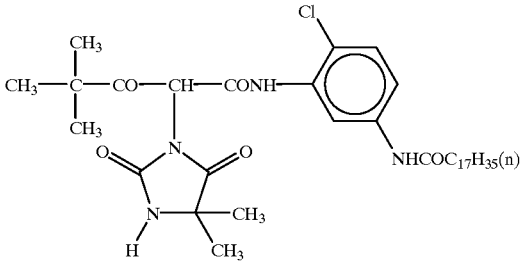

Mixture of the above compounds (mole ratio = 3:7)

-continued
(ExM-1) Magenta Coupler
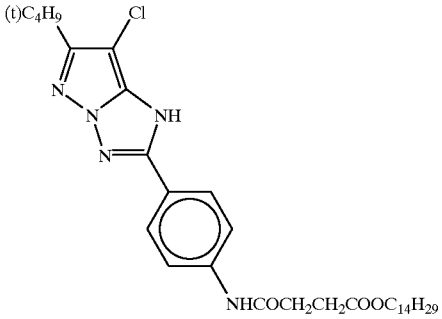
(ExM-2)
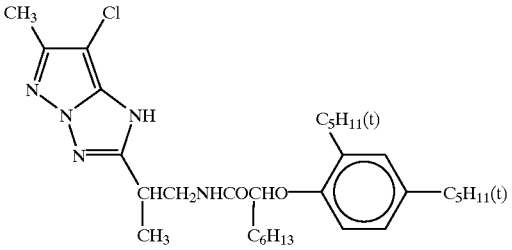
(ExC-1) Cyan Coupler
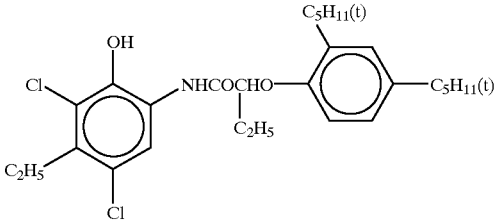
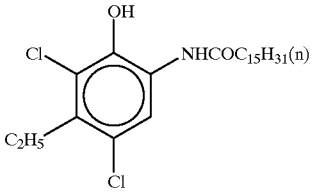
Mixture of the above compounds (mole ratio = 15:85)
(ExC-2)
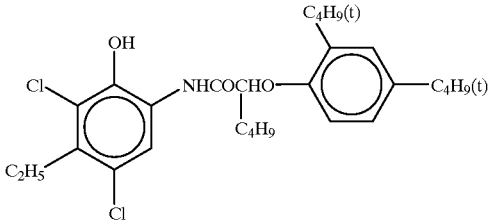
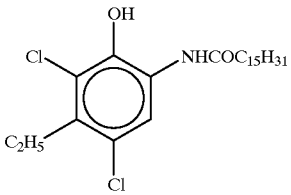
Mixture of the above compounds (mole ratio = 3:7)
(Cpd-1) Color Image Stabilizer
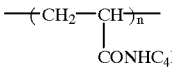
Average molecular weight = 60,000
(Cpd-2) Color Image Stabilizer
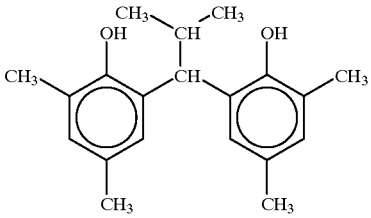
(Cpd-3) Color Image Stabilizer
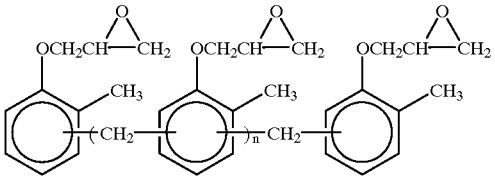
$n$ = 7~8 (average)
(Cpd-4) Color amalgamation preventing Agent Mixture of
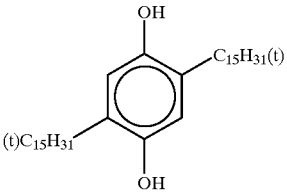
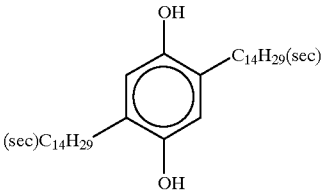
and -continued
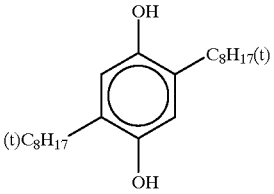
(weight ratio = 1:1:1)
(Cpd-5) Color Image Stabilizer
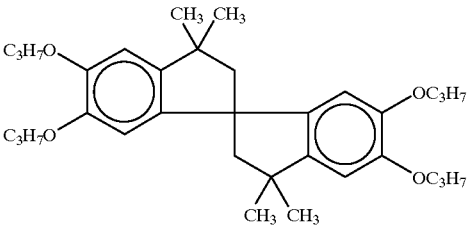
(Cpd-6) Color Image Stabilizer
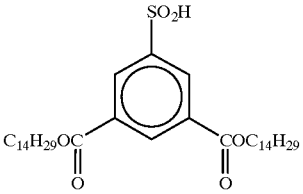
(Cpd-7) Color Image Stabilizer
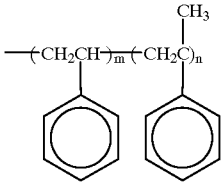
Numerical average molecure weight 600
m/n = 10/90
(Cpd-8) Color Image Stabilizer
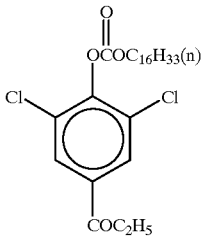
(Cpd-9) Color Image Stabilizer
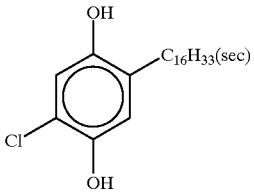
(Cpd-10) Color Image Stabilizer
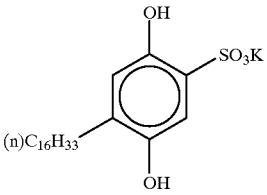
(Cpd-11) Surfactant Mixture of
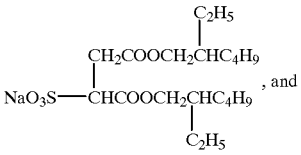
, and
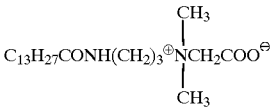
(weight ratio = 7:3)
(Cpd-12) Preservative
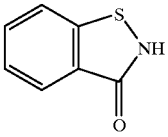
(Cpd-13) Preservative
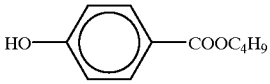

-continued
(Cpd-14) Preservative
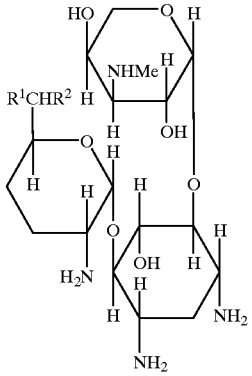
| | $R^1$ | $R^2$ |
|---|---|---|
| a | —Me | —NHMe |
| b | —Me | —$NH_2$ |
| c | —H | —$NH_2$ |
| d | —H | —NHMe |
Mixture of a, b, c and d (weight ratio = 1:1:1:1)
(Cpd-15) Preservative
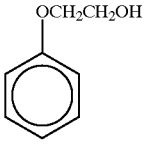
(UV-1) UV-Absorber
(1)
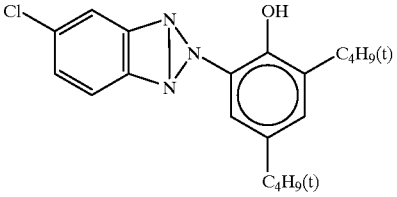
(2)
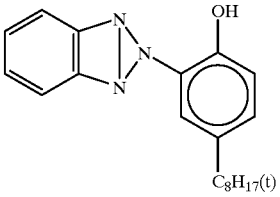
(3)
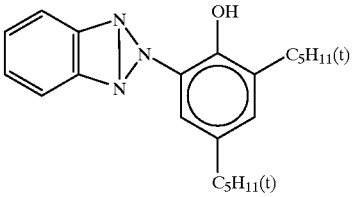
Mixture of (1), (2) and (3) (weight ratio = 1:3:4)
(UV-2) UV-Absorber
(1)
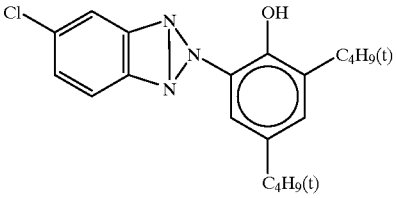
(2)
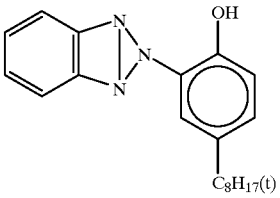
(3)
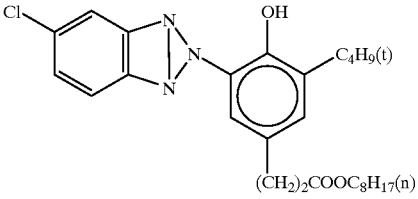
(4)
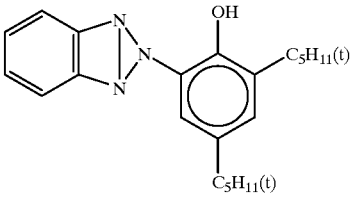
(5)
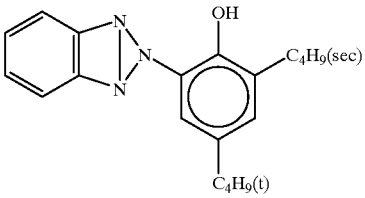
Mixture of (1), (2), (3), (4) and (5) (weight ratio = 1:2:2:3:1)

-continued (UV-3) UV-Absorber (1)

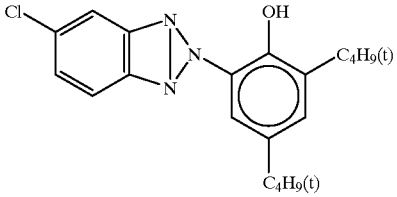

(2)

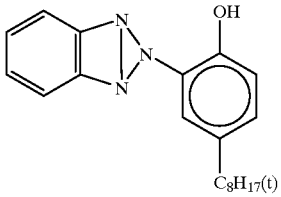

(3)

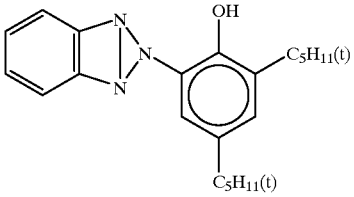

(4)

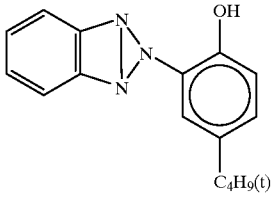

Mixture of (1), (2), (3) and (4) (weight ratio = 1:3:2:1)

(Solv-1) Solvent

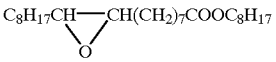

(Solv-2) Solvent

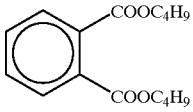

(Solv-3) Solvent

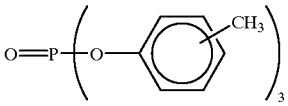

(Solv-4) Solvent

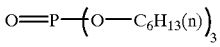

(Solv-5) Solvent

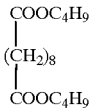

(Solv-6) Solvent

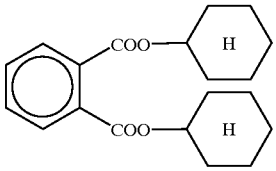

(Solv-7) Solvent

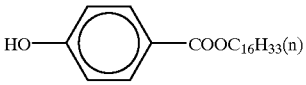

(Solv-8) Solvent

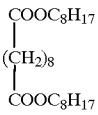

(Solv-9) Solvent

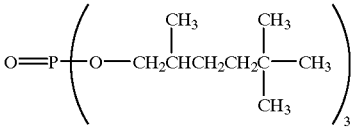

Samples 202–208 were prepared in the same manner as that used for preparing the sample 201, excepting that the yellow coupler (ExY-1) and the high b.p. solvent (Solv-1) in the first layer were replaced with respective couplers and solvents shown in Table 2 (Table B). The yellow coupler was used to conduct equivalent-mole replacement while the high b.p. solvent was used to conduct equivalent-weight replacement.

Each sample was subjected to exposure using a sensitometer (made by Fuji Photo Film Co, Ltd., model FWH, color temperature of itsght source: 3200 K) so that about 35% of the applied silver was developed to exhibit a gray color.

The above-described samples were continuously processed by a paper processor using the following processing steps. The processing solutions of respective 50 $m^2$ was treated.

| Processing step | Temperature | Time | Amount of replenishment | Volume of tank |
|---|---|---|---|---|
| Color development | 35° C. | 45 sec. | 161 ml | 10 l |
| Bleaching/fixing | 35° C. | 45 sec. | 218 ml | 10 l |
| Rinsing (1) | 35° C. | 30 sec. | — | 5 l |
| Rinsing (2) | 35° C. | 30 sec. | — | 5 l |
| Rinsing (3) | 35° C. | 30 sec. | 360 ml | 5 l |
| Drying | 80° C. | 60 sec. | | |

note: The amount of replenishment is per $m^2$.

(Rinsing was performed by a 3-tank counter flow method from (3) to (1))

The compositions of the processing solutions were as follows:

| Color developing solution | Tank solution | Replenishing solution |
|---|---|---|
| Water | 800 ml | 800 ml |
| Ethylenediaminetetraacetic acid | 3.0 g | 3.0 g |
| 2 sodium salt of 4,5-Dihydroxybenzene -1,3-disulfonic acid | 0.5 g | 0.5 g |
| Triethanolamine | 12.0 g | 12.0 g |
| Potassium chloride | 2.5 g | — |
| Potassium bromide | 0.01 g | — |
| Potassium carbonate | 27.0 g | 27.0 g |
| Fluorescent whitening agent (WHITEX 4, product of Sumitomo Chemistry Co., Ltd) | 1.0 g | 2.5 g |
| Sodium sulfite | 0.1 g | 0.2 g |
| Disodium-N,N-bis (sulfonate ethyl) hydroxylamine | 5.0 g | 8.0 g |
| N-ethyl-N-(β-methanesulfonamide | 5.0 g | 7.1 g |
| ethyl)-3-methyl-4-aminoaniline 3/2 sulfate · $1H_2O$ | | |
| Total amount after adding water | 1000 ml | 1000 ml |
| pH (at 25° C., adjusted with potassium hydroxide and sulfuric acid) | 10.05 | 10.45 |

Bleaching/fixing solution (the tank solution and the replenishing solution were the same)

| | |
|---|---|
| Water | 600 ml |
| Ammonium thiosulfate (700 g/liter) | 100 ml |
| Ammonium sulfite | 40 g |
| Iron (III) (ethylenediamine tetraacetate) ammonium | 55 g |
| Iron ethylenediamine-tetraacetate | 5 g |
| Ammonium bromide | 40 g |
| Sulfuric acid (67%) | 30 g |
| Total amount after adding water | 1000 ml |
| pH (at 25° C., adjusted with acetic acid and aqueous ammonia | 5.8 |

Rinsing solution (the tank solution and the replenishing solution were the same)

| | |
|---|---|
| Chlorinated sodium isocyanurate | 0.02 g |
| Deionized water (conductivity: not greater than 5 μs/cm) | 1000 ml |
| pH | 6.5 |

Next, each sample was subjected to gradation exposure using blue light, and was processed using the above-described processing solutions. After processing, the color development density of the sample was measured using blue light to obtain a yellow maximum color development density Dmax.

Subsequently, the samples were stored for 20 days while being exposed to Xe light of 100,000 lux (intermittent irradiation of alternating 5-hour irradiation and 1-hour non-irradiation. Separately, these samples were stored for 20 days at 80° C. and 70% RH. Thereafter, respective color image residual rates were obtained about the point where initial density was 1.0. The results of the measurement are shown in Table B.

TABLE B

| Sample | Coupler | High b.p. solvent | Dmax | color image residual rate (Xe) | (80° C.-70%) | |
|---|---|---|---|---|---|---|
| 201 | ExY-1 | Solv-1 | 2.17 | 75 | 72 | C |
| 202 | ExY-1 | R-1 (Solv-2) | 2.20 | 78 | 74 | C |
| 203 | ExY-1 | S-1 | 2.26 | 87 | 81 | I |
| 204 | ExY-1 | S-10 | 2.25 | 88 | 82 | I |
| 205 | ExY-2 | Solv-1 | 2.19 | 62 | 65 | C |
| 206 | ExY-2 | R-1 (Solv-2) | 2.21 | 66 | 66 | C |
| 207 | ExY-2 | S-1 | 2.30 | 83 | 78 | I |
| 208 | ExY-2 | S-10 | 2.29 | 85 | 80 | I |

As is apparent from Table B, when the high b.p. solvents defined in the present invention are used, higher color developing ability and higher image fastness can be obtained simultaneously.

Example 3

Samples 301–306 were manufactured in the same manner as that used for preparing the sample 205 of Example 2, excepting that the high b.p. solvent (Solv-1) in the first layer were replaced with Solv-2, and the coupler and the high b.p. solvent in the third layer were changed as shown in Table C. Each sample was subjected to gradation exposure using green light, and was processed in the same manner as that used in Example 2.

The densities of the samples were measured using green light to obtain their maximum color development densities. Subsequently, the samples were stored for 3 weeks while being exposed to Xe light of 100,000 lux (intermittent irradiation of alternating 5-hour irradiation and 1-hour non-irradiation. There-after, respective color image residual rates were measured about the point where initial density was 0.5. Also, the density of the white background portion was measured using blue light. The results of the measurement are shown in Table C.

TABLE C

| Sample | Coupler | High b.p. solvent | Dmax | Color Image residual rate (Xe) | Stain (Xe) | |
|---|---|---|---|---|---|---|
| 301 | ExM-1 | R-1 (Solv-2) | 2.04 | 71 | 0.17 | C |
| 302 | ExM-1 | S-1 | 2.18 | 86 | 0.10 | I |
| 303 | ExM-1 | S-10 | 2.20 | 89 | 0.09 | I |
| 304 | ExM-2 | R-1 (Solv-2) | 2.02 | 80 | 0.14 | C |
| 305 | ExM-2 | S-1 | 2.16 | 88 | 0.10 | I |
| 306 | ExM-2 | S-10 | 2.18 | 89 | 0.09 | I |

As is apparent from Table C, when the high b.p. solvents according to the present are used for the coupler ExM-1 or ExM-2, the image fastness against light can be greatly improved in a low color development density range (initial density: 0.5). It is also understood that additional use of the high b.p. solvent defined in the present invention reduces adverse coloring (stains) due to irradiation of light to the white background portion.

Example 4

Samples 401–409 were manufactured in the same manner as that used for preparing the sample 205 of Example 2, excepting that the high b.p. solvent Solv-1 (0.22) in the first layer were replaced with Solv-3 (0.11) and Solv-4 (0.11), and the coupler and the high b.p. solvent in the fifth layer were changed as shown in Table D.

Each sample was subjected to gradation exposure using red light, and was-processed in the same manner as that used in Example 2. The densities of the samples were measured using red light to obtain their maximum color densities.

Subsequently, the samples were stored for 2 weeks at 80° C. Thereafter, respective color image residual rates were measured about the point where initial density was 2.0. The results of the measurement are shown in Table D.

TABLE D

| Sample | Coupler | High b.p. solvent | Dmax | Color image residual rate | |
|---|---|---|---|---|---|
| 401 | ExC-1 | solv-6 | 2.10 | 78 | C |
| 402 | ExC-1 | R-1 (solv-2) | 2.06 | 74 | C |
| 403 | ExC-1 | S-10 | 2.17 | 92 | I |
| 404 | ExC-1 | S-33 | 2.15 | 91 | I |
| 405 | ExC-1 | S-2 | 2.16 | 92 | I |
| 406 | ExC-2 | S-41 | 2.15 | 85 | I |
| 407 | ExC-2 | R-1 (solv-2) | 2.02 | 70 | C |
| 408 | ExC-2 | S-1 | 2.14 | 86 | I |
| 409 | ExC-2 | S-10 | 2.13 | 87 | I |

As is apparent from Table D, when the high b.p. solvents defined in the present invention are used for the coupler ExC-1 or ExC-2, it was possible to provide a light-sensitive material having high color developing ability and excellent color fastness against heat.

The silver halide color photographic light-sensitive material according to the present invention has the above-described structure, and thus it can provide color images which are stable against heat, humidity, and light. Also, it has reduced stain and excellent color developing ability. Moreover, it contains a high b.p solvent which has a great capability of dissolving organic materials such as dye-forming couplers.

What is claimed is:

1. A silver halide color photographic light-sensitive material comprising a support having thereon one or more layers including at least one light-sensitive silver halide emulsion layer comprising at least one coupler which undergoes a coupling reaction with an oxidized product of an aromatic primary amine developer to form a dye, wherein at least one of the layer(s) on said support comprises at least one compound represented by following formula (I):

(I)

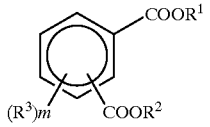

wherein $R^1$ and $R^2$, which may be the same or different, each represents an unsubstituted alkenyl group having 3–14 carbon atoms represented by following formula (II):

(II)

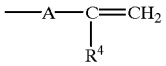

wherein $R^4$ represents a hydrogen atom or an unsubstituted alkyl group having 1–12 carbon atoms and A represents an alkylene or alkenylene group; m is an integer of 1 to 4; and $R^3$ represents an aliphatic group having 1–30 carbon atoms, an aryl group having 6–30 carbon atoms, an aliphatic oxycarbonyl group having 2–30 carbon atoms, a carbamoyl group having 1–30 carbon atoms, a halogen atom, a cyano group, an acylamino group having 1–30 carbon atoms, or an alkoxy group having 1–30 carbon atoms;

wherein the compound represented by formula (I) is present in an amount of at least 0.001 g per $m^2$ of the light-sensitive material.

2. A silver halide color photographic light-sensitive material according to claim 1, wherein said aromatic primary amine developer is -N-ethyl-N-(β-methanesulfonamidoethyl)-3-methyl-4-aminoaniline.

3. A silver halide color photographic light-sensitive material according to claim 1, wherein $R^4$ is a hydrogen atom or a methyl group.

4. A silver halide color photographic light-sensitive material according to claim 1, wherein the compound represented by the formula (I) is selected from the group consisting of:

S-2

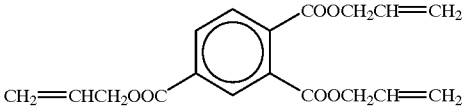

S-3

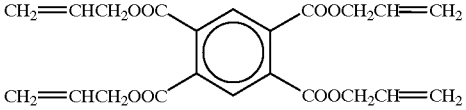

S-4

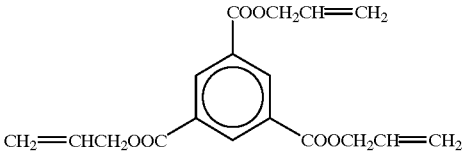

S-5

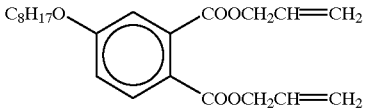

S-6

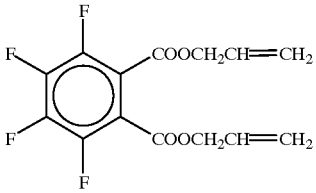

S-7

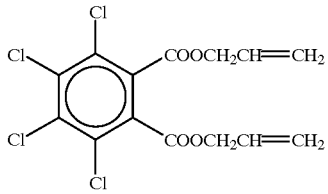

-continued

S-15

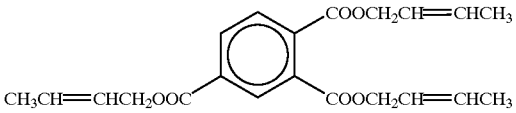

S-16

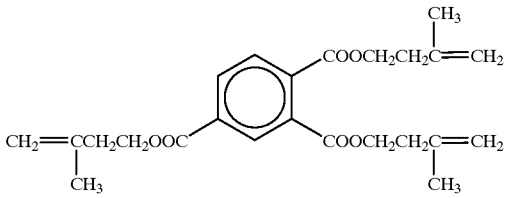

S-17

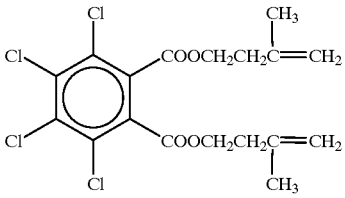

S-18

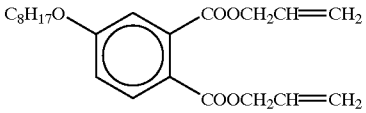

S-24

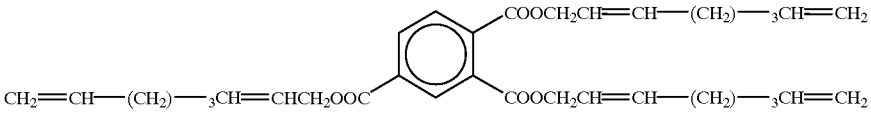

S-25

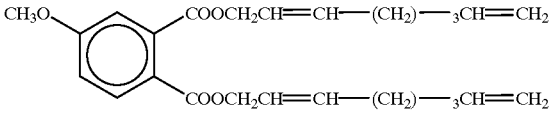

S-26

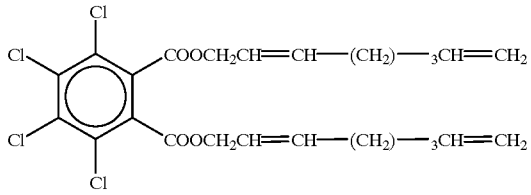

S-27

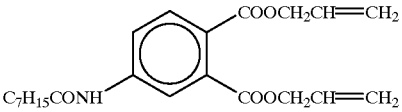

S-28

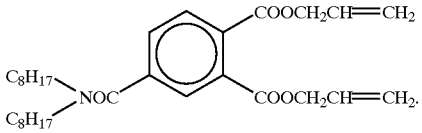

5. A silver halide color photographic light-sensitive material according to claim 1, wherein the compound represented by the formula (I) is S-2.

6. A silver halide color photographic light-sensitive material according to claim 1, wherein the compound represented by the formula (I) is S-3.

7. A silver halide color photographic light-sensitive material according to claim 1, wherein the compound represented by the formula (I) is S-4.

8. A silver halide color photographic light-sensitive material according to claim 1, wherein the compound represented by the formula (I) is S-5.

9. A silver halide color photographic light-sensitive material according to claim 1, wherein the compound represented by the formula (I) is S-6.

10. A silver halide color photographic light-sensitive material according to claim 1, wherein the compound represented by the formula (I) is S-7.

11. A silver halide color photographic light-sensitive material according to claim 1, wherein the compound represented by the formula (I) is S-15.

12. A silver color photographic light-sensitive material according to claim 1, wherein the compound represented by the formula (I) is S-16.

13. A silver halide color photographic light-sensitive material according to claim 1, wherein the compound represented by the formula (I) is S-17.

14. A silver halide color photographic light-sensitive material according to claim 1, wherein the compound represented by the formula (I) is S-18.

15. A silver halide color photographic light-sensitive material according to claim 1, wherein the compound represented by the formula (I) is S-24.

16. A silver halide color photographic light-sensitive material according to claim 1, wherein the compound represented by the formula (I) is S-25.

17. A silver halide color photographic light-sensitive material according to claim 1, wherein the compound represented by the formula (I) is S-26.

18. A silver halide color photographic light-sensitive material according to claim 1, wherein the compound represented by the formula (I) is S-27.

19. A silver halide color photographic light-sensitive material according to claim 1, wherein the compound represented by the formula (I) is S-28.

20. A silver halide color photographic light-sensitive material according to claim 1, wherein the compound represented by formula (I) is present in an amount of 0.0002 to 20 g per $m^2$ of the light-sensitive material.

21. A silver halide color photographic light-sensitive material according to claim 1, wherein $R^3$ represents an aliphatic group having 4–30 carbon atoms, an aryl group having 6–30 carbon atoms, an aliphatic oxycarbonyl group having 2–30 carbon atoms, a carbamoyl group having 1–30 carbon atoms, a halogen atom, a cyano group, an acylamino group having 1–30 carbon atoms, or an alkoxy group having 1–30 carbon atoms.

22. A silver halide color photographic light-sensitive material according to claim 1, wherein $R^3$ represents an aryl group having 6–30 carbon atoms, an aliphatic oxycarbonyl group having 2–30 carbon atoms, a carbamoyl group having 1–30 carbon atoms, a halogen atom, a cyano group, an acylamino group having 1–30 carbon atoms, or an alkoxy group having 1–30 carbon atoms.

23. A silver halide color photographic light-sensitive material according to claim 1, wherein the compound represented by formula (I) is present in an amount of 0.001 to 5 g per $m^2$ of the light-sensitive material.

* * * * *